US006978504B1

(12) United States Patent
Smith et al.

(10) Patent No.: US 6,978,504 B1
(45) Date of Patent: Dec. 27, 2005

(54) MULTIFUNCTIONAL IRRIGATION TOOL

(75) Inventors: Alan John Smith, Bountiful, UT (US); Michael Ray Ericksen, Farmington, UT (US); Rodger Leroy Fulwider, Springville, UT (US)

(73) Assignee: Orbit Irrigation Products, Bountiful, UT (US)

( * ) Notice: Subject to any disclaimer, the term of this patent is extended or adjusted under 35 U.S.C. 154(b) by 29 days.

(21) Appl. No.: 10/726,217

(22) Filed: Dec. 2, 2003

(51) Int. Cl.[7] ..... B25B 15/00
(52) U.S. Cl. ..... 7/165; 81/439; 81/177.4
(58) Field of Search ..... 7/165, 108; 81/438–439, 81/177.4, 177.1

(56) References Cited

U.S. PATENT DOCUMENTS

| | | | | |
|---|---|---|---|---|
| 2,596,594 | A | 5/1952 | Petre | |
| 2,641,478 | A | 6/1953 | Sigg | |
| 3,114,401 | A | 12/1963 | Johnson | |
| 4,448,097 | A | 5/1984 | Rocca | |
| 5,450,775 | A | 9/1995 | Kozak | |
| 5,533,429 | A * | 7/1996 | Kozak | 81/439 |
| 5,819,612 | A | 10/1998 | Anderson | |
| 5,868,048 | A | 2/1999 | Cassutti et al. | |
| 5,904,080 | A | 5/1999 | Anderson et al. | |
| 6,120,363 | A | 9/2000 | Dunn | |
| 6,202,512 | B1 | 3/2001 | O'Brien et al. | |
| 6,209,428 | B1 | 4/2001 | Anderson et al. | |
| 6,260,980 | B1 | 7/2001 | Ping | |
| 6,286,400 | B1 * | 9/2001 | Anderson et al. | 81/439 |
| 6,305,256 | B1 | 10/2001 | Anderson et al. | |
| 6,352,010 | B1 | 3/2002 | Giarritta et al. | |
| 6,354,177 | B2 | 3/2002 | Peters | |
| 6,405,396 | B1 * | 6/2002 | Tsai | 7/165 |
| 6,408,723 | B1 | 6/2002 | Zurbuchen | |
| 6,425,307 | B1 | 7/2002 | Chen | |
| 6,494,121 | B1 | 12/2002 | Hu | |
| 6,883,406 | B2 * | 4/2005 | Yang | 81/438 |

FOREIGN PATENT DOCUMENTS

| | | |
|---|---|---|
| GB | 403769 | 1/1934 |

* cited by examiner

*Primary Examiner*—Lee D. Wilson
(74) *Attorney, Agent, or Firm*—Madson & Metcalf

(57) ABSTRACT

A multifunctional hand tool is disclosed having multiple tool components for use to service and repair sprinkler and irrigation systems. The hand tool includes eight tool implements positioned on four reversible tool couplings. Each one of the four tool couplings are received by an end of one of two reversible servant couplings. The two servant couplings are each received by an end of a master coupling. The master coupling is received by a threaded insert. The insert is then received by a handle. The handle includes a retractable rotary head key for extracting a rotary sprinkler head, a releasable clamp, and a sprinkler nozzle adjustment mechanism for adjusting the spray pattern of a sprinkler nozzle.

18 Claims, 4 Drawing Sheets

MULTIFUNCTIONAL IRRIGATION TOOL

BACKGROUND OF THE INVENTION

1. Field of the Invention

The present invention relates to hand tools containing multiple tool components for performing various tasks with a single tool. More specifically, the present invention relates to a hand tool with multiple tool components for use in servicing and repairing irrigation and sprinkler equipment.

2. Description of Related Art

It is important for professional servicemen, such as locksmiths, electricians, plumbers, and irrigation contractors, as well as do-it-yourselfers, to carry a variety of tools to a specific location or job site for use in their work involving maintenance and repair of mechanical structures. As each tool is generally sold separately, servicemen are required to carry a complete set of tools to a job site for use in their work.

As is often the case, special carrying devices such as a tool box or tool belt are necessary to transport the different tools that are required to accomplish each task of maintenance or repair. As a consequence, a user's tool belt or box becomes cluttered with hand tools. Furthermore, the task of transporting a large number of tools becomes cumbersome, requiring a great deal of time and effort that would be better spent in repairing or servicing a particular mechanical structure.

Various multifunctional hand tool devices have been developed to address these problems. Most of these devices incorporate a screwdriver-like hand tool that has a handle and a shank. In some devices, different screwdriver bits are stored within a cavity in the handle. A handle could enclose several Phillips screwdriver bits, several flat-head screwdriver bits, and a Torx screwdriver bit. Each bit can be engaged by the shank that extends from the handle. Accordingly, one hand tool could perform the function of four, six, or even eight different screwdrivers.

In other devices the screwdriver bits may be disposed in one or a plurality of reversible couplings that form the shank of the hand tool. In such a device the coupling can engage a screwdriver bit in either end. One end of the coupling is inserted into a cavity in the handle exposing a screwdriver bit in the other end. The coupling is capable of being removed from the cavity, rotated 180°, and reinserted into the cavity to expose the opposite end of the coupling with a different screwdriver bit. Each of the screwdriver bits has a different screwdriver head on each end; accordingly, the screwdriver bits could also be removable from the coupling and reversed.

A hand tool having a reversible coupling engaging two reversible screwdriver bits forms a four-in-one screwdriver tool. Other devices expand on this design by providing two smaller couplings that fit into each end of the larger coupling. The smaller coupling then engages a screwdriver bit on either end. Each smaller coupling then contains two reversible screwdriver bits, and the larger coupling contains the two smaller couplings forming an eight-in-one screwdriver tool.

The aforementioned multifunctional screwdriver devices work well in general applications when multiple screwdriver sizes may be needed. However, other industries, particularly the irrigation and sprinkler industry, require the use of a plurality of different tools, in addition to multiple screwdrivers, for servicing and repair of sprinkler equipment.

As a result, as many as twenty different tools, or more, may be required to service different components common to most sprinkler systems. Carrying such a large number of tools from one location to another becomes cumbersome, and is particularly inefficient if one of the needed tools is left behind. Consequently, a great deal of time and effort which would be better spent in repairing or servicing sprinkler systems is wasted on locating, gathering, and transporting the required tools.

Accordingly, a need exists for a multifunctional tool that incorporates multiple tools needed for use in servicing and repair of sprinkler and irrigation systems into one hand-held tool. In meeting this need it is also desirable for the multifunctional irrigation tool to be ergonomic and relatively compact. Such a device is disclosed and claimed herein.

SUMMARY OF THE INVENTION

The present invention has been developed in response to the present state of the art, and in particular, in response to the problems and needs in the art that have not yet been fully solved by currently available multifunctional hand tools. Thus, the present invention provides a multifunctional irrigation hand tool with multiple tool components for use in servicing and repair of sprinkler and irrigation systems.

The hand tool of the present invention has tool components for unclogging sprinkler head nozzles, adjusting the spray arc of a sprinkler head, and tightening or loosening screws or fasteners on sprinkler systems. The hand tool further has tool components for extracting pop-up stems of sprinkler heads, extracting sprinkler rotary heads, and maintaining pop-up stems in an extended configuration. Additionally, the hand tool has tool components for perforating irrigation tubing, adjusting sprinkler nozzle spray patterns, and driving nut heads.

In accordance with the invention as embodied and broadly described herein in the preferred embodiment, a multifunctional irrigation hand tool is provided. According to one configuration, the hand tool may comprise eight tool implements located on four tool couplings. The tool implements may be a variety of tools that perform various functions and tasks to aid those who service or repair sprinkler or irrigation systems. Each tool coupling has two opposing ends, with a tool implement on each end thereof. Each tool coupling also has a body portion with a hexagonal cross-sectional shape between the tool implements.

A first tool coupling has a pick on one end. The pick is useful for unclogging sprinkler nozzles by removing rocks, dirt, or other forms of debris. A first Phillips head screwdriver bit could be on the other end of the first tool coupling. The Phillips head screwdriver bit is useful in turning screws or tightening or loosening fasteners on sprinkler system components.

A second tool coupling could have a punch at one end. The punch may be used for creating holes or otherwise perforating irrigation tubing. Opposite the punch is a flat blade. The blade is a thin metal tool that is sized to fit within the slotted portion of most sprinkler head nozzles for removing obstructing rocks, dirt, or other debris.

The first and second tool couplings are slidably received by a first servant coupling. The first servant coupling has two opposing ends, with inner cavities located on each end thereof. The inner cavities may have a hexagonal cross-sectional shape for receiving the body portions of the tool couplings, each of which also has a hexagonal cross-sectional shape. The inner cavities of the first servant coupling can also function as nut drivers.

A third tool coupling has a hex key on one end. The hex key can be used to turn correspondingly sized hexagonal keyholes on sprinkler heads to adjust the sprinkler spray arc or the spray distance. On the opposite end of the third tool coupling is a second Phillips screwdriver bit sized differently from the first Phillips screwdriver bit. The second Phillips screwdriver bit performs a similar function as that of the first Phillips screwdriver bit, namely turning screws or tightening or loosening fasteners on sprinkler system components.

A fourth tool coupling could have two flat-head screwdriver bits, one at each end of the tool coupling. The two flat head screwdriver bits have different sized heads for turning different sized screws. The flat head screwdriver bits could also be used for tightening or loosening fasteners on sprinkler system components.

The third and fourth tool couplings are slidably received by a second servant coupling. The second servant coupling, like the first servant coupling, has two opposing ends, with inner cavities located on each end thereof. The inner cavities may have a hexagonal cross-sectional shape for receiving the body portions of the tool couplings, each of which also has a hexagonal cross-sectional shape. The inner cavities of the first servant coupling can also function as nut drivers.

The multifunctional irrigation hand tool also includes a master coupling for slidably receiving the first and second servant couplings. The servant couplings are received into either of two inner cavities. The inner cavities are located at opposing ends of the master coupling. Each of the inner cavities has a hexagonal cross-sectional shape to receive the hexagonal servant couplings. The inner cavities are also sized to function as nut drivers.

Either end of the servant couplings can be inserted into either inner cavity of the master coupling. Likewise, either end of the tool couplings can be inserted into either inner cavity of either of the servant couplings. Therefore, the master coupling, when engaged with all component parts contains two servant couplings, four tool couplings and eight tool implements.

The multifunctional irrigation hand tool also has a threaded insert to slidably receive the master coupling. The threaded insert has a hollow portion with a hexagonal cross-sectional shape that extends from one end to the other for receiving the master coupling. The insert has male threads on the exterior of a first end. The insert further has male and female threads on the exterior and interior of a second end, respectively. The threaded ends are sized to engage corresponding male or female threads of a variety of sprinkler pop-up stems. Once engaged, the threaded insert can be used to extract the stem to extend it above the ground.

The hand tool also has a handle with an ergonomic grip for slidably receiving the threaded insert. The handle has a proximal end and a distal end, and an internal cavity accessible from the proximal end of the handle. The insert is slidably received by the internal cavity on the proximal end. The handle also has a clamp that releasably engages a portion of the exterior of the handle. The clamp can be used to engage a pop-up stem of a sprinkler head once it has been extracted. When the clamp is engaged with the extracted pop-up stem, the clamp is able to maintain the stem in an extended configuration for servicing and repair of the sprinkler head.

The handle also has a rotary head key located on the distal end. The rotary head key is movable between a retracted position and an extended position. When extended, the rotary head key fits into a correspondingly-sized keyhole on a rotary sprinkler head in order to extend the sprinkler head above ground for servicing or repair. Also on the distal end of the handle are two protrusions. The protrusions are designed to engage corresponding indentations on a sprinkler nozzle so that the handle can be rotated to rotate the sprinkler nozzle in order to adjust the spray pattern of the nozzle.

When fully assembled, the hand tool has one tool implement projecting out of the shank. The shank comprises the combination of the threaded insert, the master coupling and one of the two servant couplings. If a different tool implement is desired, the user need only remove the master coupling from the insert and rotate the master coupling 180° if needed, then rotate the servant coupling containing the desired tool implement if needed, and finally rotate the tool coupling containing the desired tool implement, if needed. All components are then reassembled into the hand tool in order to use the desired tool implement.

As mentioned above, the hand tool of the present invention is able to extract various kinds of sprinkler heads. To extract a rotary sprinkler head, the rotary head key is moved from a retracted position within the handle to an extended position. The key is inserted into a correspondingly-shaped keyhole and the hand tool is turned 90° and pulled upward, moving the rotary sprinkler head into an extended configuration. Alternatively, to extract a sprinkler head pop-up stem into an extended configuration, the threaded insert engages the threads of the pop-up stem in a retracted position and is pulled to extend the pop-up stem. To maintain the pop-up stem in its extended configuration, the clamp is disengaged from the handle of the handle tool and the clamp is then engaged with the extended pop-up stem.

The method of manufacturing the multifunctional irrigation hand tool could be accomplished in a variety of ways. The currently contemplated method of manufacture is to cast the metal tool couplings, and perform additional machining thereafter. The handle includes a metal insert and can thereby be insert molded. The threaded insert is metal, but alternatively could be made of plastic. A metal threaded insert would be machined and a plastic threaded insert would be injection molded.

These and other features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 6, is not intended to limit the scope of the invention, as claimed, but is merely representative of presently preferred embodiments of the invention.

Figure 1:
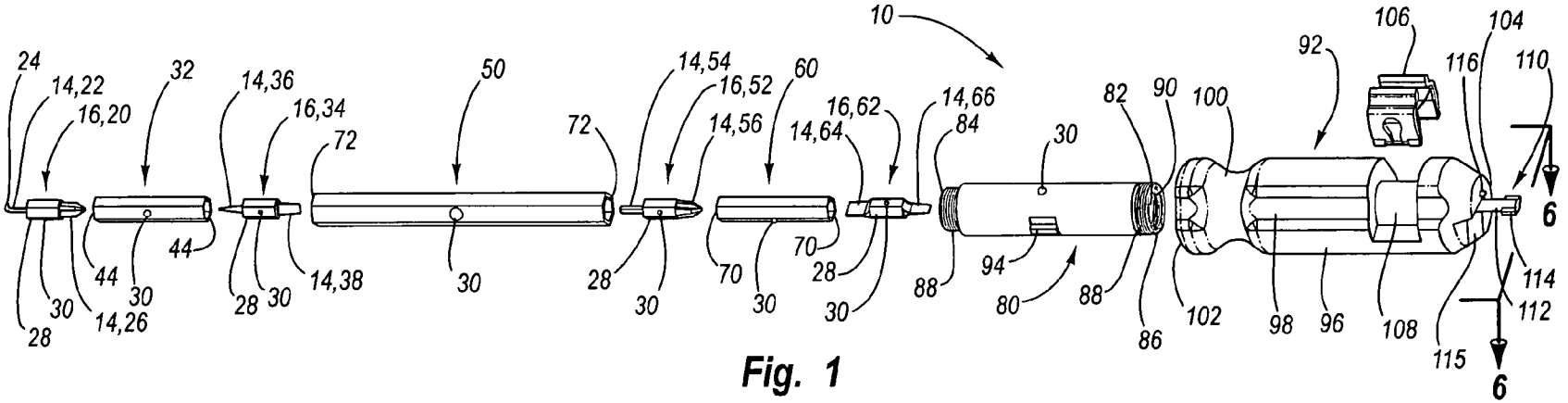
FIG. 1 is an exploded, perspective view of a multifunctional irrigation hand tool of the present invention with its component parts.

Referring to FIG. 1, a multifunctional irrigation hand tool 10 is depicted with all component parts in an exploded perspective view. The hand tool 10 has multiple tool components that may be used for sprinkler or irrigation systems. Specifically, the hand tool 10 can be used to service, maintain, or repair sprinkler system apparatuses. Some of the various functions the hand tool 10 can perform are unclogging sprinkler head nozzles, adjusting the spray arc of a sprinkler head, tightening or loosening fasteners on sprinkler systems, extracting pop-up stems of sprinkler heads, extracting sprinkler rotary heads, maintaining pop-up stems in an extended configuration, perforating irrigation tubing, adjusting sprinkler nozzle spray patterns, and driving nut heads. The hand tool 10 is capable of performing other functions, not enumerated above, that will be apparent to those skilled in the art from the ensuing description of each component part.

The hand tool 10 of the present embodiment has eight tool implements 14 located on four tool couplings 16. Each of the tool couplings 16 has two opposing ends, with a tool implement 14 on each end thereof. Alternatively, the hand tool 10 could comprise fewer tool implements 14 than eight or fewer tool couplings 16 than four. Furthermore, each of the tool couplings 16 could also have only one tool implement 14 on one end thereof.

The tool implements 14 could be a variety of tools that perform various functions to aid those servicing or repairing sprinkler or irrigation systems. On one end of a first tool coupling 20 is a pick 22. The pick 22 has a pointed tip 24 that is useful in removing rocks, dirt, or other kinds of debris from a sprinkler nozzle. Clogged sprinkler nozzles often do not deliver water in a desired spray pattern, or sometimes do not deliver water at all. Grass or other vegetation may become dry and die if they do not receive the proper quantity of water that would otherwise be delivered from the sprinkler head if the nozzle were not clogged. The features of the pick 22 will be discussed in greater detail in conjunction with the description of FIG. 5.

A first Phillips head screwdriver bit 26 may be located on an end opposite the pick 22 on the first tool coupling 20. The first Phillips screwdriver bit 26 may be used in tightening or loosening fasteners used in sprinkler systems. The fasteners may be screws that not only connect sprinkler components to each other, but are also used to control other properties of sprinkler systems such as controlling the flow of water through the sprinkler nozzle. The features of the first Phillips screwdriver bit 26 will be discussed in greater detail in conjunction with the description of the first tool coupling 20 in FIG. 5. Alternative tool implements 14 may be used on the first tool coupling 20 if desired, including, but not limited to the other tool implements 14 to be disclosed.

The first tool coupling 20 has a body portion 28 between the tool implements 14 on opposing ends. The body portion 28 may have a hexagonal cross-sectional shape to facilitate slidable receipt of the first tool coupling 20 into a first servant coupling 32. The body portion 28 could alternatively have a pentagonal, heptagonal, octagonal, or other polygonal cross-sectional shape if desired. The shape of the body portion 28 corresponds to that of the cross-sectional shape of an internal cavity of the first servant coupling 32.

A small protrusion 30 is also located on the body portion 28 of the first tool coupling 20. The protrusion 30 may be a ball and spring detent mechanism that can be deflected to allow slidable receipt of the first tool coupling 20 into the first servant coupling 32. The ball and spring mechanism is a friction detent mechanism, in that it is deflected when the first tool coupling 20 is inserted into the first servant coupling 32, and maintains pressure against the first servant coupling 32 to prevent the first tool coupling from becoming disengaged with the first servant coupling 32. Alternatively, the ball and spring detent mechanism could engage a corresponding indentation inside the first servant coupling 32 to slidably retain the first tool coupling 20 in the first servant coupling 32. The protrusion 30, alternatively could be a hemispherical member integrally formed with the body portion 28 of the first tool coupling 20.

Referring still to FIG. 1, a second tool coupling 34 is depicted for slidable receipt into the first servant coupling 32. The second tool coupling 34 depicted has a punch 36 at one end. The punch 36 is a sharp, conical-shaped tool that may be used for creating holes in irrigation tubing, such as a drip irrigation conduit, or alternatively, for removing debris from sprinkler head nozzles. The punch 36 will be described in greater detail in conjunction with FIG. 5. Also on the second tool coupling 34, opposite the punch 36, is a flat blade 38. The flat blade 38 is a thin metal tool sized to fit within sprinkler nozzle openings to remove rocks, dirt, and other debris from sprinkler nozzles. The flat blade 38 will be described in greater detail in conjunction with FIG. 5.

Like the first tool coupling 20, the second tool coupling 34 has a body portion 28 between tool implements 14, the body portion 28 having a hexagonal cross-sectional shape. Alternatively, the body portion 28 could have a pentagonal, octagonal, square or other polygonal cross-sectional shape. Also on the body portion 28 of the second tool coupling 34 is a protrusion 30 to allow slidable receipt of the second tool coupling 34 into the first servant coupling 32. The protrusion 30 may be a ball and spring detent that operates similarly to the ball and spring detent described in accordance with the first tool coupling 20.

Referring still to FIG. 1, the first servant coupling 32 slidably receives the first and second tool couplings 20, 34. The first servant coupling 32 is a tube-like structure, having a hexagonal cross-sectional shape. Alternatively, the first servant coupling 32 could have a pentagonal, octagonal, or other polygonal cross-sectional shape corresponding to the cross-sectional shape of the body portions 28 of the first and second tool couplings 20, 34.

The first servant coupling 32 has opposing ends with two inner cavities 44, one on each end thereof. The inner cavities 44 slidably receive the first and second tool couplings 20, 34. The inner cavities 44 may be separated from each other by a wall portion. The inner cavities 44 of the first servant coupling 32 have a hexagonal cross-sectional shape to function as a nut driver to drive correspondingly sized nut heads. The inner cavities 44 may be sized to act as standard-sized ¼" nut drivers. Alternatively, the inner cavities 44 may be sized to act as 3/16", 7/32", 9/32", 5/16", 3/8", or similarly sized standard or metric nut drivers.

The exterior of the first servant coupling 32 has a protrusion 30 that may be a ball and spring detent mechanism that can be deflected to allow slidable receipt of the first servant coupling 32 into a master coupling 50. The ball and spring mechanism is a friction detent mechanism, in that it is deflected when the first servant coupling 32 is inserted into the master coupling 50, and maintains pressure against the master coupling 50 to prevent the first servant coupling 32 from becoming disengaged with the master coupling 50. Alternatively, the protrusion 30 could be a hemispherical member integrally formed with the exterior of the first servant coupling 32.

Referring still to FIG. 1, a third tool coupling 52 has two opposing ends, with tool implements 14 at either end. A hex key 54 is located on one end of the third tool coupling 52. The hex key 54 can be used to turn a correspondingly sized hexagonal keyhole on a rotary sprinkler head which adjusts the sprinkler spray arc or to turn a distance adjustment socket for a rotary sprinkler head. On the opposite end of the third tool coupling 52 is a second Phillips screwdriver bit 56. The second Phillips screwdriver bit 56 of the third tool coupling 52 performs a similar function as that of the first Phillips screwdriver bit 26 of the first tool coupling 20, except that one is larger than the other. The tool implements 14 of the third tool coupling 52 will be discussed with greater detail in conjunction with the description of FIG. 5.

Like the first and second tool couplings 20, 34, the third tool coupling 52 has a body portion 28 between opposing tool implements 14. The body portion 28 has a hexagonal cross-sectional shape, sized to be slidably received by a second servant coupling 60. Also like the first and second tool couplings 20, 34, a protrusion 30 is located on the body portion 28 of the third tool coupling 52. Like the protrusions of the first and second tool couplings 20, 34, the protrusion 30 is a ball and spring detent mechanism, or alternatively an integrally formed hemispherical member for retaining the third tool coupling 52 in the second servant coupling 60.

A fourth tool coupling 62 has two opposing ends, with a tool implement 14 at either end thereof. A first flat-head screwdriver bit 64 is located on one end of the fourth tool coupling 62. The first flat-head screwdriver bit 64 may have a standard ¼" head. Alternatively, the first flat-head screwdriver bit 64 may have a larger or smaller sized head, while still being insertable into the second servant coupling 60. A second flat-head screwdriver bit 66 is located on the other end of the fourth tool coupling 62. The second flat-head screwdriver bit 66 may have a standard 3/16" head. As with the first flat-head screwdriver bit 64, the second flat-head screwdriver bit 66 may have a different sized head while still allowing insertion of the fourth tool coupling 62 into the second servant coupling 60. The first and second flat-head screwdriver bits 64, 66 will be discussed in greater detail in conjunction with the discussion of FIG. 5.

Like the first, second, and third tool couplings 20, 34, 52, the fourth tool coupling 62 has a body portion 28 between opposing tool implements 14. The body portion 28 has a hexagonal cross-sectional shape, sized to be slidably received by the second servant coupling 60. Also like the first, second, and third tool couplings 20, 34, 52, a protrusion 30 is located on the body portion 28 of the fourth tool coupling 62. The protrusion 30 is a ball and spring detent mechanism for retaining the fourth tool coupling 62 in the second servant coupling 60, or alternatively, could be a hemispherical member integrally formed with the body portion 28 of the fourth tool coupling 62.

The tool implements 14 located on the four tool couplings 20, 34, 52, 62 described above are part of one embodiment of the present invention. Various other tool implements 14 may be used on the tool couplings 16 on an alternative embodiment. Different keys, screwdriver bits, or nozzle unclogging members may be used instead of the tool implements 14 disclosed. Alternatively, the various tool implements 14 may be located on different tool couplings 16 as presently described.

Referring still to FIG. 1, the second servant coupling 60 is like the first servant coupling 32, in that the second servant coupling 60 slidably receives the third and fourth tool couplings 52, 62. The second servant coupling 60 has a hexagonal cross-sectional shape. Alternatively, the second servant coupling 60 could have a pentagonal, square, or other polygonal cross-sectional shape corresponding to the cross-sectional shape of the body portions 28 of the third and fourth tool couplings 52, 62.

The second servant coupling 60 has opposing ends with two inner cavities 70, one on each end. The inner cavities 70 slidably receive the third and fourth tool couplings 52, 62. The inner cavities 70 may be separated from each other by a wall portion. With a hexagonal cross-sectional shape, the inner cavities 70 of the second servant coupling 60 can function as nut drivers to drive correspondingly sized nut heads. The inner cavities 70 may be sized to act as standard-sized ¼" or 5/16" nut drivers, or may have a variety of other alternative sizes like those of the first servant coupling 32.

Also like the first servant coupling 32, the exterior of the second servant coupling 60 has a protrusion 30 that is a ball and spring detent mechanism to allow slidable receipt and retention of the second servant coupling 60 into the master coupling 50. Alternatively, the protrusion 30 is an integrally formed hemispherical member.

The multifunctional irrigation hand tool 10 also includes a master coupling 50 for slidably receiving the first and second servant couplings 32, 60. The master coupling 50 has opposing ends with two inner cavities 72, one on each end. A wall portion (not shown) inside the master coupling 50 separates the two inner cavities 72. The inner cavities 72 depicted have hexagonal cross-sectional shapes to receive the hexagonally-shaped servant couplings 32, 60. The hexagonal inner cavities 72 of the master coupling 50 can function as nut drivers to drive correspondingly sized nut heads. The inner cavities 72 may be 3/8" nut drivers or any alternative, standard-sized nut drivers as described in conjunction with the description of the first servant coupling 32. Alternatively, the master coupling 50 could have a different polygonal cross-sectional shape or size corresponding to the cross-sectional shapes of the two servant couplings 32, 60.

Either end of the servant couplings 32, 60 can be inserted into either inner cavity 72 of the master coupling 50. Likewise, either end of the tool couplings 16 can be inserted into either inner cavities 44, 70 of either servant couplings 32, 60. Therefore the master coupling 50, when engaged with all corresponding parts contains two servant couplings 32, 60, four tool couplings 16, and eight tool implements 14. Since the tool couplings 16, servant couplings 32, 60, and master coupling 50 have similar polygonal cross-sectional shapes, free rotation of each component of the multifunctional irrigation hand tool 10 is limited with respect to each component. Free rotation with respect to each component is also limited by the hemispherical protrusions 30 located on the exterior of the body portions 28 of the tool couplings 16 and servant couplings 32, 60. The polygonal cross-sectional shapes and hemispherical protrusions 30 constitute rotation limiting mechanisms.

Referring still to FIG. 1, a threaded insert 80 having a hollow portion 82 is depicted. The insert 80 has a first end 84 and a second end 86, where the hollow portion 82 extends from the first end 84 to the second end 86. The hollow portion 82 has a hexagonal cross-sectional shape (as seen from FIGS. 3A and 3B), for receiving the hexagonally shaped master coupling 50. As is true with the master coupling 50, the cross-sectional shape of the insert 80 could alternatively be a different polygonal shape, such as a square, pentagonal, or heptagonal shape corresponding to the polygonal shape of the master coupling 50.

Like the servant couplings 32, 60, the master coupling 50 has a protrusion 30 on its exterior to act as a friction detent mechanism in retaining the master coupling inside the threaded insert 80. The protrusion 30 could be a ball and spring detent that is deflected when the master coupling 50 is inserted into the threaded insert 80, and maintains pressure against the interior of the threaded insert 80 to prevent the master coupling 50 from becoming disengaged with the threaded insert 80 by gravity or other means. Alternatively, the protrusion 30 could be a hemispherical member integrally formed with the exterior of the master coupling 50.

The first end 84 of the insert 80 is threaded on the exterior. Male threads 88 on the first end 84 are sized to engage corresponding female threads (not shown) of a sprinkler pop-up stem. Once engaged, the threaded insert can be used to extract the stem from a retracted configuration below the ground to an extended configuration, above ground. The threaded insert 80 thereby acts as a sprinkler head extraction tool. Male threads 88 are also located on the second end 86 of the insert 80. The male threads 88 on the second end 86 may be larger than the male threads 88 on the first end 84 in order to engage a pop-up stem of a different kind of sprinkler head.

The threaded insert 80 is further threaded on the interior of the second end 86 forming female threads 90. The female threads 90 are sized to engage corresponding male threads (not shown) on a pop-up stem of a third kind of sprinkler head. The three different threaded portions of the insert 80 correspond in size to three major brands of sprinkler heads made by the manufacturers ORBIT, RAIN BIRD, and TORO.

The threaded insert 80 has a protrusion 30 on its exterior, like the tool couplings 16, and the master 50 and servant couplings 32, 60. The protrusion 30 is a spring and ball detent that is deflected when the insert 80 is inserted into an internal cavity of a handle 92. The detent mechanism maintains pressure against the interior of the handle 92 to prevent the insert 80 from becoming disengaged with the handle 92 by gravity or other means. Alternatively, the protrusion 30 could be a hemispherical member integrally formed with the exterior of the threaded insert 80.

The insert 80 further has two projections 94 that extend substantially orthogonal from the outer surface of the insert. The projections 94 could be in the form of tabs that are disposed on opposite sides of the threaded insert 80. The projections 94 slidably engage corresponding recesses in a wall of the cavity of the handle 92. The projections 94 on the insert 80 therefore act as rotation limiting mechanisms to limit the rotation of the insert 80 within the handle 92.

Referring still to FIG. 1, the handle 92 of the multifunctional irrigation hand tool 10 has an ergonomic grip portion 96 with longitudinal channels 98 and an annular recess 100 to facilitate a nimble grasp of the handle 92 by a user's hand. The grip portion 96 of the handle 92 may be plastic or a molded soft grip formed of an elastomer or the like. The handle 92 has a proximal end 102 and a distal end 104, and the annular recess 100 is located adjacent the proximal end 102 of the handle 92.

The threaded insert 80 is slidably received by the cavity of the handle 92 on the proximal end 102. A releasably engaged clamp 106 is located between the proximal 102 and distal 104 ends, on the exterior of the handle 92. The clamp 106 removably engages a gap portion 108 in the handle 92. The clamp 106 can be used to engage a pop-up stem of a sprinkler head once it has been extracted. Once the clamp 106 is engaged with the extracted pop-up stem it is able to maintain the stem in the extended configuration for servicing and repair.

A retractable rotary head key 110 is coupled to the distal end 104 of the handle 92. For this application, the phrase "coupled to" means any form of interaction between two or more entities, the two entities not necessarily in direct contact with each other. The rotary head key 110 is capable of being longitudinally retracted within the handle 92 when not in use, and extended when needed. The rotary head key 110 has a shaft 112 with two orthogonal projections 114 that can be engaged with a correspondingly shaped keyhole (not shown) in a rotary sprinkler head. Once the rotary head key 110 is inserted into the keyhole, the multifunctional irrigation tool 10 is rotated 90° and pulled upward to extend the rotary sprinkler head from a retracted configuration below ground, to an extended configuration above ground. The rotary head key 110 is therefore a sprinkler head extraction tool.

The rotary head key 110 also has a ball and spring detent (see FIG. 6) near its base for maintaining the shaft 112 in an extended position. The distal end 104 of the handle 92 has a notch 115 adjacent to the rotary head key 110, to permit a user's finger to engage the rotary head key 110 in a retracted position, and move the shaft 112 into an extended position for insertion into the keyhole of the rotary sprinkler head.

Adjacent to the rotary head key 110 on the distal end 104 of the handle 92 are two protrusions 116. The protrusions 116 are different from the protrusions 30 on the other components of the hand tool 10, in that they are not a detent mechanism. These protrusions 116 act as a nozzle adjustment mechanism and correspond in size to indentations on the top of sprinkler nozzles. The protrusions 116 on the distal end 104 of the handle 92 are designed to engage the indentations on the sprinkler nozzle, such that rotation of the handle 92 causes the sprinkler nozzle to rotate to adjust the spray pattern of the nozzle.

When the master coupling 50 is fully assembled with the tool couplings 16 and servant couplings 32, 60, either end can be inserted into the hollow portion 82 of the threaded insert 80. The threaded insert 80 can then be slidably retained by the internal cavity of the handle 92.

When fully assembled the multifunctional irrigation hand tool 10 has one tool implement 14 projecting out of the shank of the hand tool 10. The shank comprises the combination of the threaded insert 80, the master coupling 50 and one of the two servant couplings 32, 60. If a different tool implement 14 is desired, the user need only remove the master coupling 50 from the insert 80 and rotate the master coupling 50 180°, rotate the servant coupling 32, 60 containing the desired tool implement 14, and/or rotate the tool coupling 16 containing the desired tool implement 14. All components are then reassembled into the hand tool 10 to use the desired tool implement 14.

Various parts of FIG. 1 may be altered, rearranged, omitted, or supplemented with additional parts in a variety of ways. For instance, the hand tool 10 could include different tool implements 14, such as nut drivers, star keys or Torx screwdrivers in place of the tool implements 14 disclosed. Additionally, the master coupling 50 need not have a hexagonal or polygonal cross-sectional shape, but could be cylindrical. Also by way of example, the servant couplings 32, 60 could be omitted, thereby leaving just two tool couplings 16 that engage the opposing ends of the master coupling 50. Many such variations would be envisioned by one of skill in the art through the aid of the present disclosure.

Figure 2:
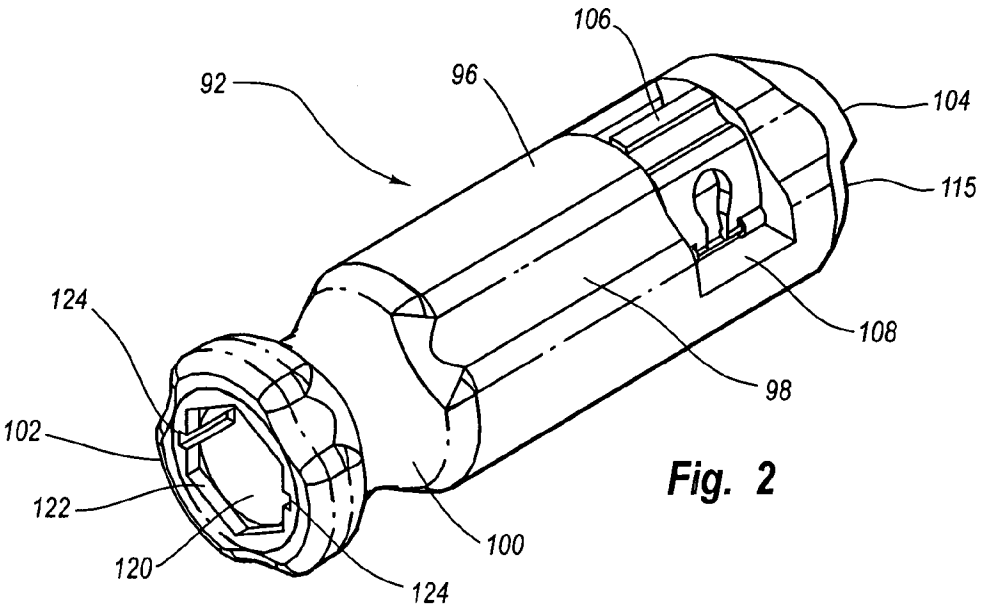
FIG. 2 is a perspective view of a handle of the multifunctional irrigation hand tool of FIG. 1.

Referring now to FIG. 2, the handle 92 of the multifunctional irrigation hand tool 10 of FIG. 1 is depicted in a perspective view, looking toward the proximal end 102 of the handle 92. As mentioned previously, the grip portion 96 of the handle 92 could be constructed of rigid plastic, a molded soft grip such as an elastomer, or an alternative material. The grip portion 96 has three longitudinal channels 98 that extend from the distal end 104 to the proximal end 102. An annular recess 100 is also located adjacent the proximal end 102. The channels 98 and annular recess 100 provide for an ergonomic grip portion 96 that allows a user to grasp and turn the handle 92 without slippage when torque is imparted to the hand tool 10.

The handle 92 has an internal cavity 120 that is open on the proximal end 102. The internal cavity 120 is sized to slidably receive the threaded insert 80. The internal cavity 120 is defined by an inner wall 122 of the handle 92. The inner wall 122 has recesses 124 that correspond in size and shape to the projections 94 that extend orthogonally from the side of the threaded insert 80. The interaction of the projections 94 of the insert 80 and the recesses 124 in the inner wall 122 of the handle 92 prevent rotation of the insert 80 and handle 92 relative to each other when torque is applied to the hand tool 10. The projections 94 and recesses 124 comprise a rotation limiting mechanism of the hand tool 10.

The internal cavity 120 of the handle 92 has a hexagonal cross-sectional shape. The hexagonal shape allows the handle 92 to turn corresponding hexagonal structures on sprinkler and irrigation equipment. In order to use the handle 92 in this capacity, the threaded insert 80 and all other components must be removed from the internal cavity 120 of the handle 92. Alternatively, the cross-sectional shape of the internal cavity 120 could be a different polygonal or circular shape. Likewise, the threaded insert 80 could have an alternative cross-sectional shape, such as being hexagonal, or partially hexagonal, between threaded ends 84, 86.

The exterior of the handle 92 has a gap portion 108 that is sized to engage a releasable clamp 106. The gap portion 108 is deep enough relative to the grip portion 96 of the handle 92 so that the clamp 106, once engaged with the handle 92, does not project significantly past the profile of the handle 92. Maintaining a uniform profile is not a necessary quality, but is desirable to provide comfort and prevent injury to a user when firmly grasping the handle 92.

Figure 3B:
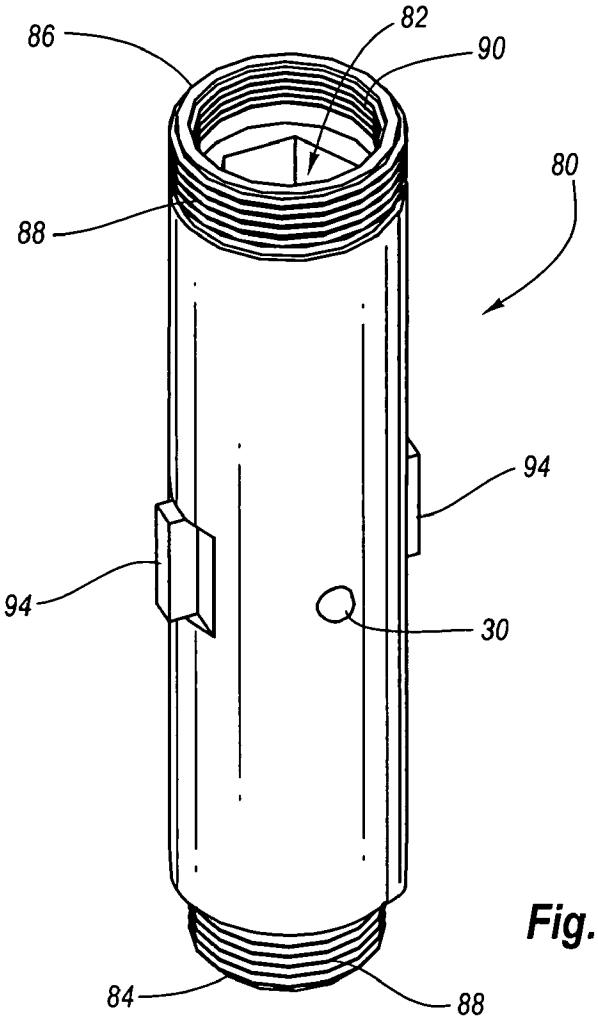
FIG. 3B is a perspective view of the threaded insert of FIG. 3A, from a viewpoint illustrating the second end of the threaded insert.
Figure 3A:
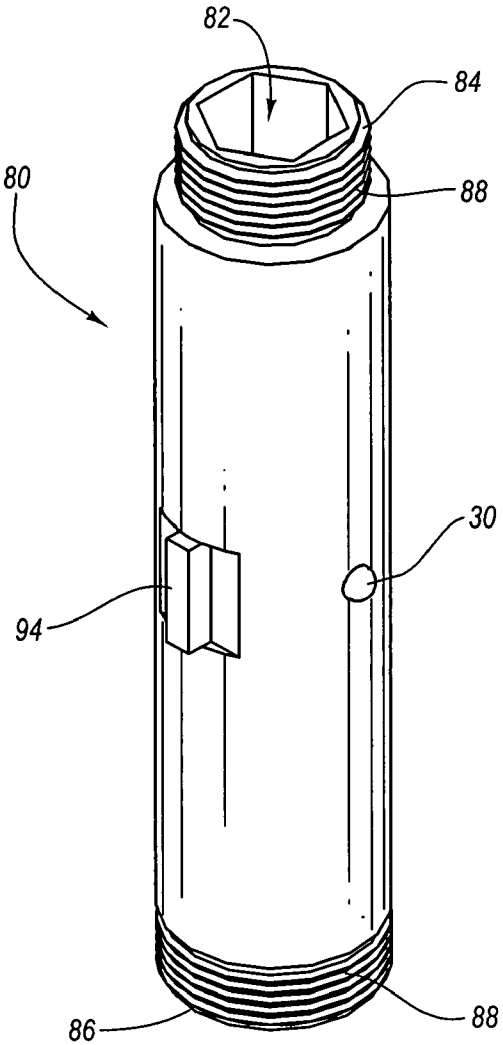
FIG. 3A is a perspective view of a threaded insert of the multifunctional irrigation hand tool of FIG. 1, from a viewpoint illustrating the first end of the threaded insert.

Referring now to FIGS. 3A and 3B, the threaded insert 80 is depicted in a perspective view illustrating the first end 84 in FIG. 3A. FIG. 3B is a perspective view of the threaded insert 80 in which the second end 86 is shown. As mentioned previously, the insert 80 has a hollow portion 82 that extends from the first end 84 to the second end 86. The hollow portion 82 has a hexagonal cross-sectional shape for receiving the hexagonal master coupling 50. Alternatively, the hollow portion 82 could have a polygonal or circular cross-sectional shape corresponding to the shape of the master coupling 50. The hexagonal cross-sectional shape of the hollow portion 82 allows the first end 84 of the insert 80 to act as a nut driver to drive correspondingly-sized standard nut heads.

The first end 84 of the insert 80 has male threads 88 on its exterior. Male threads 88 are also located on the exterior of the second end 86. The male threads 88 on the first end 84 may be a different size than the male threads 88 on the second end 86 so as to engage different corresponding female threads (not shown) on sprinkler system components. The second end 86 of the insert 80 is further threaded on its interior, forming female threads 90. The female threads 90 are sized to engage corresponding male threads (not shown) on sprinkler system components.

The three different threaded portions of the insert 80 are sized to engage corresponding male or female threads on a sprinkler pop-up stem made by one of three major sprinkler head manufacturers, namely, ORBIT, RAIN BIRD, and TORO. Once engaged with the threaded pop-up stem, the insert 80 can be used to extract the stem from a retracted configuration below the ground to an extended configuration, above ground. The threaded insert 80 thereby acts as a sprinkler head extraction tool.

As discussed above, the insert 80 has two projections 94 that extend substantially orthogonal from the outer surface of the insert 80. The projections 94 may take the form of tabs that are disposed on opposite external sides of the insert 80. The projections 94 engage corresponding recesses formed in the wall of the handle cavity 120 to limit the rotation of the insert 80 within the handle 92 when torque is applied to the hand tool 10.

The insert 80 further has a protrusion 30 that is a ball and spring detent mechanism for preventing the insert 80 from becoming disengaged with the handle 92 by gravity or other forces. The protrusion 30 is deflected orthogonally, toward the center of the insert 80 when received by the internal cavity 120 of the handle 92. The protrusion 30 maintains pressure against the internal cavity 120 wall, thereby preventing the insert 80 from sliding out of its position within the handle 92. Alternatively, the protrusion 30 could be a hemispherical member integrally formed with the exterior of the insert 80.

Figure 4:
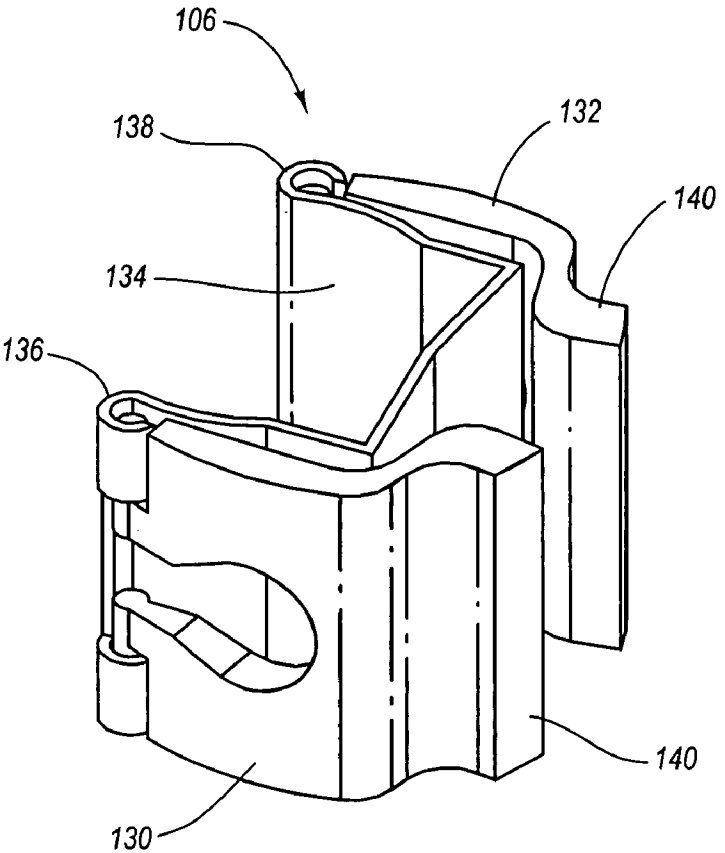
FIG. 4 is a perspective view of a clamp that engages a portion of the handle of the multifunctional irrigation hand tool of FIG. 1.

Referring now to FIG. 4, the clamp 106 that removably engages the handle 92 is depicted in a perspective view. The clamp 106 has first and second squeeze handles 130, 132 that are hingedly connected to a bracket member 134 on a first and second end 136, 138. The first end 136 of the bracket member 134 is spaced apart from the second end 138. The first and second squeeze handles 130, 132 have grip portions 140 that can be squeezed together to deflect the first and second ends 136, 138 of the bracket member 134 further apart from each other.

The clamp 106 can be used to engage a pop-up stem (not shown) of a sprinkler head once the stem has been extracted with a sprinkler head extraction tool. The clamp 106 engages the stem when the grip portions 140 of the first and second squeeze handles 130, 132 are squeezed to deflect the first and second ends 136, 138 of the bracket member 134. The deflected first and second ends 136, 138 are then positioned on either side of the pop-up stem. Once the squeeze handles 130, 132 are released, the pop-up stem is retained in an extended configuration because the engaged clamp 106 prevents the stem from sliding back into its retracted configuration.

Figure 5:
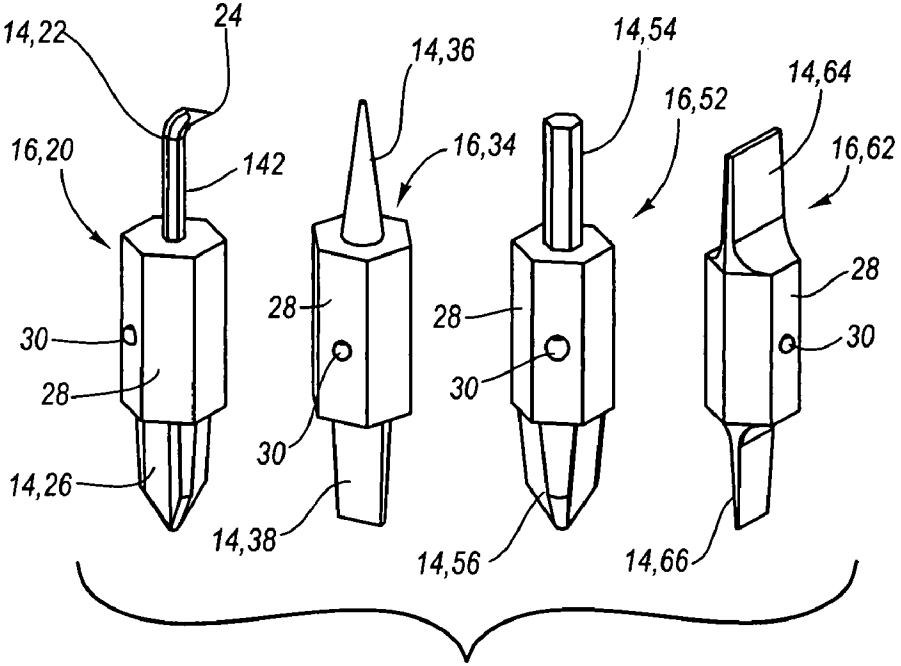
FIG. 5 is a perspective view of four exemplary reversible tool couplings with eight tool implements of the multifunctional irrigation hand tool of FIG. 1.

Referring to FIG. 5, the reversible tool couplings 16 and associated tool implements 14 are depicted in a perspective view. As set forth previously, each tool coupling 16 has two opposing ends with a tool implement 14 located at each end. Alternatively, the tool couplings 16 need not have a tool implement 14 on both ends, but could just have a single tool implement 14 on one end thereof.

Each of the tool couplings 16 has a body portion 28 between the two tool implements 14 on either end. The body portion 28 has a hexagonal cross-sectional shape to facilitate slidable receipt of the tool couplings 16 into the hexagonal cross-sectional inner cavities of the first and second servant couplings 32, 60. Alternatively, the body portion 28 could have a different polygonal cross-sectional shape, such as a pentagon, octagon, square, or the like if so desired. The cross-sectional shape of the body portion 28 should correspond with the cross-sectional shape of the servant couplings 32, 60 to prevent relative rotation of the tool couplings 16 within the servant couplings 32, 60.

As also stated previously, each tool coupling 16 may also have a small protrusion 30 on the body portion 28 to retain engagement of the tool coupling 16 with its respective servant coupling 32, 60. The protrusion 30 may be a ball and spring detent mechanism that can be deflected inward, toward the center of the body portion 28, when the tool coupling 16 is received by the servant coupling. The ball and spring detent maintains pressure against the servant couplings 32, 60 to prevent the tool coupling 16 from becoming disengaged.

Referring still to FIG. 5, the first tool coupling 20 has a pick 22 on one end. The pick 22 is a sharp implement with a shaft 142 extending longitudinally from the body portion 28. The shaft 142 curves or otherwise changes direction and forms a pointed tip 24. The pick 22 may be used to remove rocks, dirt, or other debris from various sprinkler head nozzles. The pick 22 may be used to remove debris from typical slotted pop-up sprinkler head nozzles or from rotary sprinkler head nozzles.

The first Phillips head screwdriver bit 26 may be located on the other end of the first tool coupling 20, opposite the pick 22. The first Phillips head screwdriver bit 26 may be a standard number 1-size Phillips head for tightening or loosening fasteners, such as screws, used in sprinkler systems. Screws that can receive a number 1-size Phillips screwdriver also are used to adjust other properties of some sprinkler nozzles, such as the flow rate of water, and can be adjusted accordingly with the first tool coupling 20.

As discussed above, the second tool coupling 34 of the present invention may have a punch 36 at one end. The punch 36 is a conical-shaped tool that has a sharp, pointed tip. The punch 36 is of robust construction in order to withstand pressures exerted against it in creating holes in irrigation tubing. It is desirable to perforate irrigation tubing to deliver water to vegetation in various types of drip-systems. The punch 36 could alternatively be used for removing debris from clogged nozzles, and hence could act as a nozzle unclogging member.

The flat blade 38 may be located on an end opposite the punch 36 on the second tool coupling 34. The flat blade 38 is a thin metal tool, projecting longitudinally from the body portion 28 of the second tool coupling 34. The flat blade 38 is sized to fit within slotted sprinkler nozzle openings to remove rocks, dirt, and other debris so that water can be delivered to vegetation properly.

Like the first and second tool couplings 20, 34, the third tool coupling 52 also has two tool implements 14, one at each opposing end. On one end of the third tool coupling 52 is a hex key 54. The hex key 54 comprises a narrow shaft extending longitudinally from the body portion 28 of the third tool coupling 52, having a hexagonal cross-sectional shape. The hex key 54 may be used to turn correspondingly sized hexagonal keyholes on various rotary sprinkler heads. By turning the hex key 54 in the keyhole, the sprinkler spray arc is regulated or the distance adjustment socket is adjusted.

On the opposite end of the third tool coupling 52 is the second Phillips screwdriver bit 56. The second Phillips screwdriver bit 56 performs a similar function to that of the first Phillips screwdriver bit 26 of the first tool coupling 20, except that the second Phillips bit 56 may be a larger number 2 Phillips head.

Like the other tool couplings 16, the fourth tool coupling 62 also has two opposing ends with tool implements 14 at either end. The first flat-head screwdriver bit 64 is located on one end of the fourth tool coupling 62 and the second flat-head screwdriver bit 66 is located at the other end. The flat-head screwdriver bits 64, 66 can be used to adjust screws or other fasteners on sprinkler system components. The first and second flat-head screwdriver bits 64, 66 could have head sizes of ¼" and 3⁄16", respectively. However, the flat-head screwdriver bits 64, 66 may be sized differently, such as standard sizes ⅜", 5⁄16", or 5⁄32", or alternative metric sizes such as 5 mm or 6 mm.

The tool implements 14 of FIG. 5 may be altered, rearranged, omitted, or supplemented with additional parts in a variety of ways. For instance, the tool couplings 16 could include different tool implements 14, such as nut drivers, star keys or Torx screwdrivers in place of the tool implements 14 disclosed. Additionally, the placement of each tool implement 14 could be rearranged to be on different tool couplings 16. Many such variations would be envisioned by one of skill in the art through the aid of the present disclosure.

Figure 6:
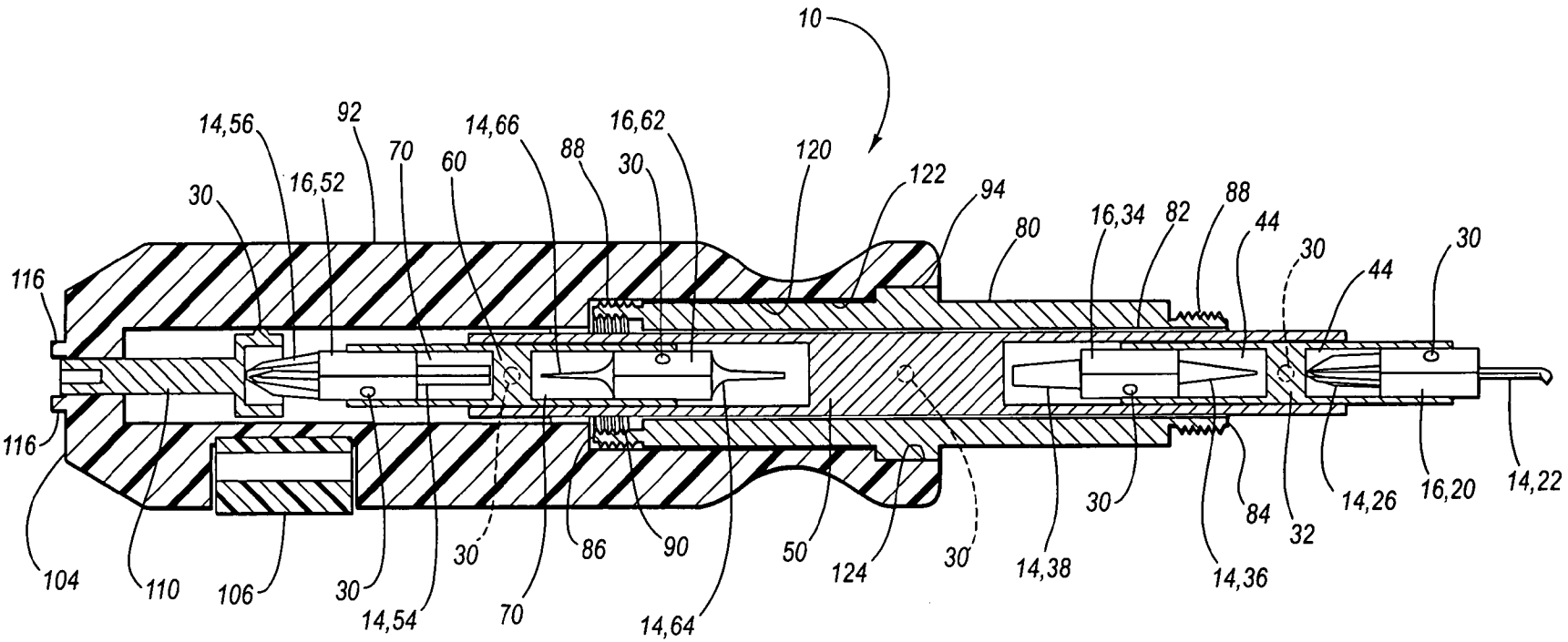
FIG. 6 is a side elevation, partial cross-sectional view of the assembled multifunctional irrigation hand tool of FIG. 1.

Referring to FIG. 6, the multifunctional irrigation hand tool 10 is shown with all component parts fully assembled. The hand tool 10 is shown in a side elevation, partial cross-sectional view, taken along a longitudinal plane demarcated 6 in FIG. 1, except that FIG. 6 represents the assembled hand tool 10 and not an exploded view. For clarity, the tool couplings 16 and corresponding tool implements 14 are not sectioned like the rest of the hand tool 10. The protrusions 30 limiting the longitudinal displacement of the threaded insert 80, and master 50 and servant couplings 32, 60 are illustrated in phantom.

The threaded insert 80 is slidably retained within the internal cavity 120 of the handle 92. The protrusion 30 prevents the insert 80 from sliding out of the internal cavity 120 via a ball and spring detent whose mode of operation was described in conjunction with the description of FIG. 1. The orthogonal projections 94 on the insert 80 are received by the recesses 124 in the inner wall 122 of the handle 92 to limit the relative rotation of the insert 80 within the handle 92.

The master coupling 50 is then slidably received within the hollow portion 82 of the insert 80. Either end of the master coupling 50 could be inserted into the handle 92 depending on which tool implement 14 is desired. For instance, given the configuration of the tool implements 14 within the hand tool 10, the pick 22 can be utilized. If the second Phillips head screwdriver bit 56 is needed, then the master coupling 50 is removed, rotated 180°, and reinserted into the handle 92. If the first Phillips head screwdriver bit 26 is needed, then only the first tool coupling 20 need be removed, rotated 180°, and reinserted into the first servant coupling 32. Likewise, if either the punch 36 or the flat blade 38 is needed, the first servant coupling 32 could be removed from the master coupling 50, rotated 180°, and reinserted. If either flat-head screwdriver bit 64, 66 is needed, the master coupling 50 would be removed, rotated 180°, and reinserted. The same is done to the second servant coupling 60 following reinsertion of the master coupling 50, thereby exposing the fourth tool coupling 62. The multifunctional irrigation hand tool 10 thereby has at least eight tool implements 14 interchangeably disposed within the shank of the hand tool.

Each tool coupling 16 is retained within its respective servant coupling 32, 60 by virtue of a hemispherical protrusion 30 on the body portion 28, which abuts the wall of the inner cavities 44, 70 of the servant couplings 32, 60. The rotary head key 110 also has a protrusion 30 that abuts the inner wall 122 of the internal cavity 120 of the handle 92 to maintain an extended position if so desired.

The rotary head key 110 is depicted in a retracted position, longitudinally disposed within the handle 92. Adjacent the rotary head key 110, on the distal end 104 of the handle 92 are two protrusions 116. These protrusions 116 act as a nozzle adjustment mechanism, and are designed to engage correspondingly sized indentations (not shown) on a sprinkler nozzle and be rotated to adjust the spray pattern of the nozzle.

Referring now to FIGS. 1 through 6 generally, the present invention also provides for an efficient method of performing maintenance, service, or repair of a sprinkler head. First, a multifunctional irrigation hand tool 10 is obtained, having a handle 92 with an internal cavity 120 and a sprinkler head extraction tool, such as the threaded insert 80 or rotary head key 110. The hand tool 10 also includes screwdriver bits 26, 56, 64, 66, and sprinkler nozzle unclogging members, such as the pick 22, flat blade 38, and punch 36. Then the sprinkler head extraction tool 80 or 110 is engaged with a component of a sprinkler head such as a pop-up stem (not shown) or a rotary or fixed sprinkler head. The sprinkler head component is then elevated with the sprinkler head extraction tool 80 or 110. The sprinkler head component, such as a pop-up stem, could be maintained in an elevated configuration with the clamp 106, and maintenance is performed on the sprinkler head with the hand tool 10.

Such maintenance could include unclogging sprinkler head nozzles, adjusting the spray arc of a sprinkler head, tightening or loosening fasteners or screws on sprinkler systems, or adjusting the spray pattern of sprinkler nozzles. Other forms of maintenance or servicing of sprinkler systems, not enumerated above, could be performed and will be apparent to those skilled in the art through the aid of the present disclosure.

The method of manufacturing the multifunctional irrigation hand tool 10 could be accomplished in a variety of ways. The currently contemplated method of manufacture is to cast the metal tool couplings 16, and perform additional machining thereafter. The handle 92 includes a metal insert and can thereby be insert molded. The threaded insert 80 is metal, but alternatively could be made of plastic. A metal threaded insert 80 would be machined and a plastic threaded insert 80 would be injection molded.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A multifunctional hand tool, comprising:

a handle with an internal cavity;

an insert that is slidably received by the internal cavity of the handle, the insert having a hollow portion, and the insert being threaded on a first end thereof;

a master coupling that is slidably received by the hollow portion of the insert; and a first tool implement that is slidably coupled to the master coupling.

2. The hand tool of claim 1, further comprising a first servant coupling that is slidably received by the master coupling, wherein the first servant coupling slidably receives the first tool implement.

3. The hand tool of claim 2, wherein the master coupling has opposing ends, either end of which can be received by the insert, and the first servant coupling has two opposing ends, either of which can be received by either end of the master coupling.

4. The hand tool of claim 3, further comprising a first tool coupling with two opposing ends, the first tool coupling having the first tool implement and a second tool implement, wherein the first and second tool implements are disposed on either end of the first tool coupling.

5. The hand tool of claim 4, wherein either end of the first tool coupling can be inserted into either end of the first servant coupling.

6. The hand tool of claim 4, further comprising a second servant coupling, second, third, and fourth tool couplings, and second, third, fourth, fifth, sixth, seventh, and eighth tool implements.

7. The hand tool of claim 6, wherein each of the tool couplings has one of the tool implements on either end of the tool coupling, each of the servant couplings slidably receives two of the tool couplings, and the master coupling slidably receives the first and second servant couplings.

8. The hand tool of claim 4, further comprising a rotation limiting mechanism that limits relative rotation of the tool coupling with respect to the handle.

9. The hand tool of claim 1, wherein the first tool implement is a pick shaped to be usable to remove debris from clogged sprinkler nozzles.

10. The hand tool of claim 1, wherein the first tool implement is a punch shaped to be usable to pierce irrigation tubing.

11. The hand tool of claim 1, wherein the first tool implement is a hex key.

12. The hand tool of claim 1, wherein the first tool implement is a flat blade shaped to be usable to remove debris from sprinkler nozzle openings.

13. The hand tool of claim 1, further comprising a clamp that releasably engages a portion of the handle.

14. The hand tool of claim 1, further comprising a nozzle adjustment mechanism disposed on the handle to facilitate rotation of a sprinkler head nozzle with the handle.

15. The hand tool of claim 1, further comprising a rotary head key coupled to the handle, the rotary head key being movable, with respect to the handle, between a retracted position and an extended position.

16. The hand tool of claim 1, wherein the insert further comprises a second end, the insert being threaded on an exterior of both ends and on an interior of the second end.

17. The hand tool of claim 16, wherein at least one of the threaded first and second ends of the insert is sized to engage a threaded portion of a sprinkler pop-up stem.

18. The hand tool of claim 1, wherein the handle cavity comprises a hexagonal cross sectional shape.

* * * * *